United States Patent [19]

Conger, III

[11] Patent Number: 4,473,992

[45] Date of Patent: Oct. 2, 1984

[54] ADJUSTABLE SADDLE RIGGING

[76] Inventor: William W. Conger, III, Box 77C, Templeton Rd. & S. El Pomar, Templeton, Calif. 93465

[21] Appl. No.: 449,440

[22] Filed: Dec. 13, 1982

[51] Int. Cl.[3] ..... B68C 1/14

[52] U.S. Cl. ..... 54/46

[58] Field of Search ..... 54/37, 44, 45, 46

[56] References Cited

U.S. PATENT DOCUMENTS

| | | | |
|---|---|---|---|
| 34,044 | 12/1861 | Eagle | 54/46 |
| 327,165 | 9/1885 | Haslam | 54/46 |
| 1,087,557 | 2/1914 | Schoellkopf | 54/46 |
| 1,226,623 | 5/1917 | Adams . | |
| 2,418,103 | 3/1947 | Wells | 55/44 |
| 2,464,881 | 3/1949 | McClellan | 54/46 |
| 2,739,434 | 3/1956 | Bell | 54/46 |

FOREIGN PATENT DOCUMENTS

| | | | |
|---|---|---|---|
| 15866 | of 1902 | United Kingdom | 54/46 |
| 2053647 | 2/1981 | United Kingdom | 54/44 |

*Primary Examiner*—Robert P. Swiatek

*Attorney, Agent, or Firm*—Spensley, Horn, Jubas & Lubitz

[57] ABSTRACT

An adjustable rigging for horse saddles which permits the front and rear cinchas to be connected to the saddle in multiple different positions. The present adjustable saddle rigging comprises an elongate member having a track defining multiple longitudinal positions for a rigging ring, the elongate member being connected or connectable to a saddle, and a rigging ring connectable to a saddle, and a rigging ring connectable to the elongate member in any one of the multiple longitudinal positions.

7 Claims, 6 Drawing Figures

ADJUSTABLE SADDLE RIGGING

BACKGROUND OF THE INVENTION

1. Field of the Invention

The present invention relates to an adjustable rigging for horse saddles and, more particularly, to a saddle rigging which permits the front and rear cinchas to be connected to the saddle in multiple different positions.

2. Description of the Prior Art

A saddle is a piece of equipment that allows man to use a horse more efficiently. Through the years many changes have occurred, both in the breeding of high class horses and in the saddle industry. The breeding of horses has changed their entire structure in the last 30 years. No longer do we ride razor back mustangs or indian ponies. We presently ride many varieties of well-bred horses, thoroughbred, standard bred, quarter horses and many others. All of these animals have the right to be treated humanely and fitted as correctly as possible with gear so that they can work more efficiently without pain or discomfort.

Unfortunately, western saddles have not kept up with the evolution of horses. In fact, such saddles have not changed significantly in the last hundred years. They may have changed in looks, but not in their adaptability to provide comfort to a horse.

The skirt is the last part of the saddle that comes into contact with the horse's back, except for the saddle pad. Next is the rigging which attaches to the ends of the cinchas and places the cinchas in different positions. Because of the differences in structures of different horses, a saddle is typically made with a particular horse in mind and the rigging positioned in the skirt to properly locate the cinchas. Unfortunately, when a saddle is bought for one horse and then the rider wants to use it for another, the second horse is forced to accept cincha positions which may not be suitable for it.

Very often, saddles are not even designed with a particular horse in mind. Many riders use their saddles on many different horses, such as when they are training horses or switching from one horse to another. An average position is selected for the rigging hardware and each horse must tolerate the fact that the desired position of the cincha is probably different than the actual position thereof.

One prior art attempt to solve this problem is set forth in U.S. Pat. No. 2,464,881, which provides a reversible rigging ring which may be applied to and detached from a saddle in either of two positions. While such a construction is an improvement, the rigging ring of this patent is connected to the saddle in an unconventional manner, preventing its application to existing saddle designs, and the positions thereof are limited by its very nature to only two positions.

SUMMARY OF THE INVENTION

According to the present invention, the saddle rigging for a saddle is made adjustable over multiple positions so that the rider has a clear choice to put the saddle in a place that is good for the horse and good for the rider to do the job with less discomfort to both. The construction of the present adjustable saddle rigging is compatible with existing saddle designs and the saddle rigging may be positioned in at least three positions to give the rider a wide range of flexibility in adjusting the saddle to the horse. All adjustments can be made without any special tools. Furthermore, because of the adjustability of the present saddle rigging, the tolerances previously required by saddle makers in building saddles are substantially loosened, creating increased advantages for the mass production of saddles.

Briefly, the present adjustable saddle rigging comprises an elongate member having a track defining multiple longitudinal positions for a rigging ring, means for connecting the member to a saddle, and a rigging ring connectable to the member in any one of the multiple longitudinal positions. With the rigging ring positionable in any one of multiple positions, the saddle can be properly located on the horse's back and the cinchas properly positioned relative to the horse's barrel to hold the saddle in the right position.

OBJECTS, FEATURES AND ADVANTAGES

It is therefore the object of the present invention to solve the problems associated with fixed saddle riggings. It is a feature of the present invention to solve these problems by the provision of an adjustable saddle rigging including a rigging ring positionable in any one of multiple positions along the saddle. An advantage to be derived is saddle rigging which permits a horse to be fitted with a saddle as correctly as possible. A further advantage is saddle rigging which permits a horse to be treated humanely. A still further advantage is saddle rigging which may be adjusted without tools. Another advantage is a saddle which may be readily switched from one horse to another. Still another advantage is saddle rigging which loosens up tolerances for saddle makers in building saddles. Another advantage is in the ability to mass produce saddles.

Still other objects, features, and attendant advantages of the present invention will become apparent to those skilled in the art from a reading of the following detailed description of the preferred embodiments constructed in accordance therewith, taken in conjunction with the accompanying drawings wherein like numerals designate like or corresponding parts in the several figures and wherein:

DESCRIPTION OF THE PREFERRED EMBODIMENTS

Figure 1:
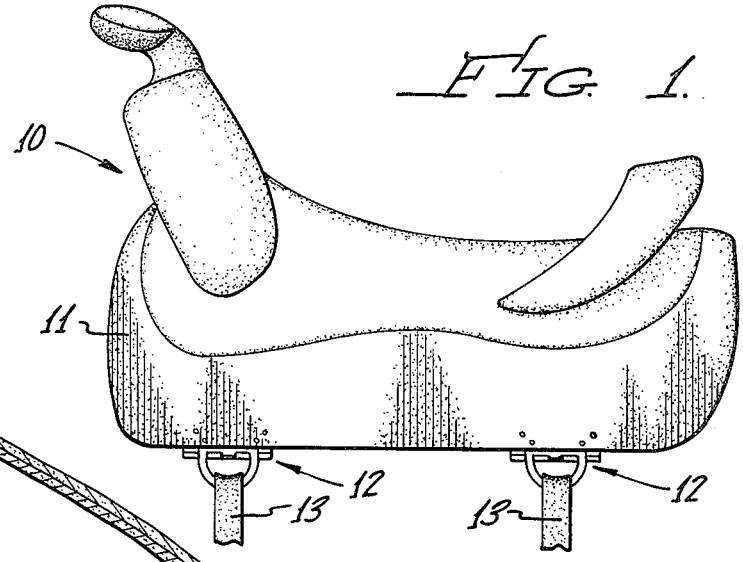
FIG. 1 is an elevation view of a saddle incorporating the present saddle rigging.
Figure 2:
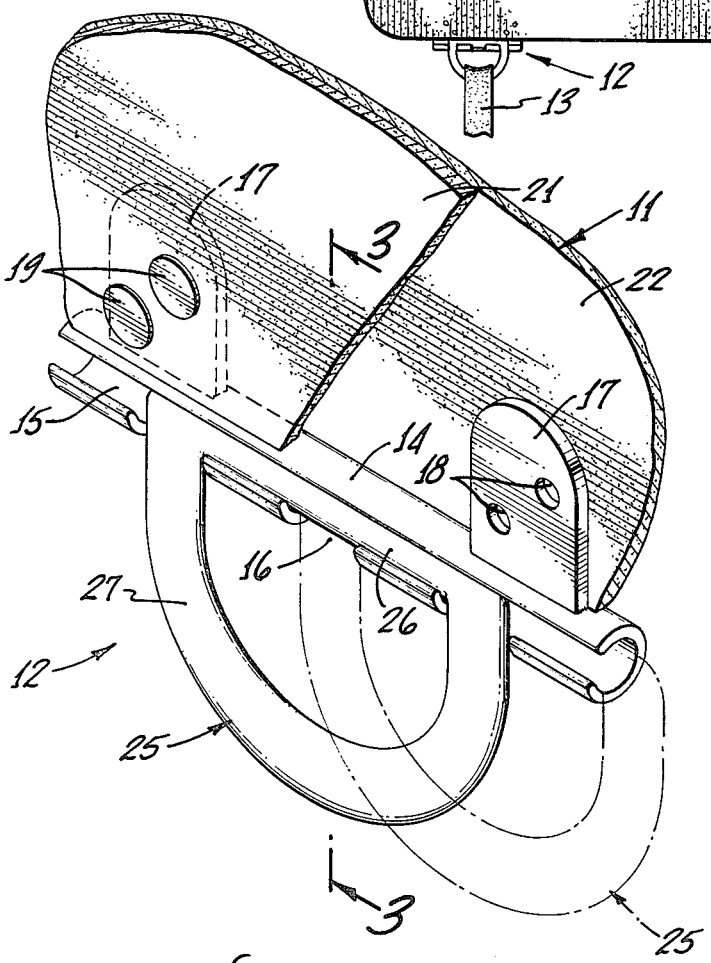
FIG. 2 is an enlarged perspective view of the present adjustable saddle rigging.
Figure 3:
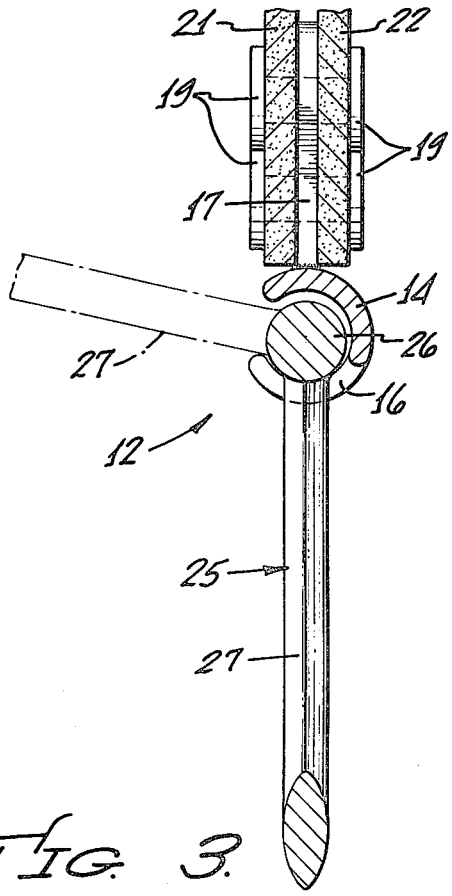
FIG. 3 is an enlarged sectional view taken along the line 3—3 in FIG. 2.

Referring now to the drawings and, more particularly, to FIGS. 1–3 thereof, there is shown a generally conventional saddle, generally designated 10, including the usual skirt 11, having connected thereto the present adjustable saddle rigging, generally designated 12. As is known in the art, four identical sets of riggings 12 would be utilized, two on each side of saddle 10, one front and one back on each side. The usual saddle cinchas 13 are connected to riggings 12. Since the four saddle riggings 12 are identical, an explanation of one will suffice to explain all.

According to the embodiment of the present invention shown in FIGS. 1–3, rigging 12 is designed to be included in saddle 10 during the manufacture thereof. Saddle rigging 12 includes an elongate member 14 having a generally C-shaped cross section. Through a major portion of member 14, the cross section circumscribes an angle of greater than 270°, leaving only a narrow opening 15. On the other hand, spaced along the length of member 14 are a series of sections where member 14 circumscribes an angle of less than 90° so as to provide a multiplicity of spaced openings 16 having a much greater extent than openings 15. As can be seen from an inspection of FIG. 2, openings 15 and 16 are spaced along the length of member 14, in an alternating pattern. In the particular embodiment of the invention shown in FIG. 2, four openings 15 are shown and three openings 16. The number of openings 15 and 16 are a matter of choice. In any event, member 14 defines a track having multiple longitudinal positions spaced therealong for receipt of a rigging ring, to be explained more fully hereinafter.

In order to secure member 14 to saddle skirt 11, rigging 12 is provided with a pair of tabs 17, each having a plurality of preformed rivet holes 18. Tabs 17 are connected to and extend perpendicularly from the side of member 14. Skirt 11 is preferably made so as to include two overlapping pieces of material 21 and 22 so that tabs 17 are positionable therebetween. With such a construction, it is a simple matter to extend a pair of rivets 19 through material pieces 21 and 22 and holes 18 in tabs 17 to securely interconnect such members.

With such a construction, two tracks are defined on each side of saddle 10, one forward and one back. These tracks receive a generally D-shaped rigging ring, generally designated 25. The dimensions of rings 25 are established so that they readily mate with member 14 and may be connectable thereto in any one of multiple longitudinal positions. A first longitudinal position is shown in solid lines in FIG. 2 whereas a second longitudinal position is shown in phantom in FIG. 2. FIGS. 2 and 3 should make it readily apparent how adjustment is made. That is, the straight portion 26 of rigging ring 25 has an outside diameter which is smaller than the inside diameter of member 14 so as to be freely slidable therethrough. The thickness of the ends of the curved portion 27 of rigging ring 25 is slightly less than the longitudinal length of openings 16 so that the ends of curved portion 27 extend through openings 16 for connection to straight portion 26. Furthermore, the spacing between the ends of curved portion 27 is such that the ends are either aligned with the two outside openings 16 or, with one end of curved portion 27 extending into the central opening 16, as shown in phantom in FIG. 2, the other end of curved portion 27 is aligned with the end of member 14.

In the usual position of rigging ring 25, that is, when it is connected to a cincha and used to connect saddle 10 to a horse, rigging ring 25 is in the position shown in FIG. 3 and cannot be moved in the longitudinal direction. When it is desired to change the location of ring 25 to adjust rigging 12 to the horse, the cincha is loosened and rigging ring 25 is rotated forwardly until curved portion 27 is aligned with openings 15. In this position, ring 25 can be readily slid along member 14 to one of the three positions discussed previously or even removed from member 14 by sliding beyond the end of member 14. As shown in FIG. 3, curved portion 27 of ring 25 is preferably flattened so that the size of opening 15 is greater than the thickness of curved portion 27 but less than the outside diameter of straight portion 26. This prevents ring 25 from being inadvertently removed from member 14 when in its elevated position.

Figure 4:
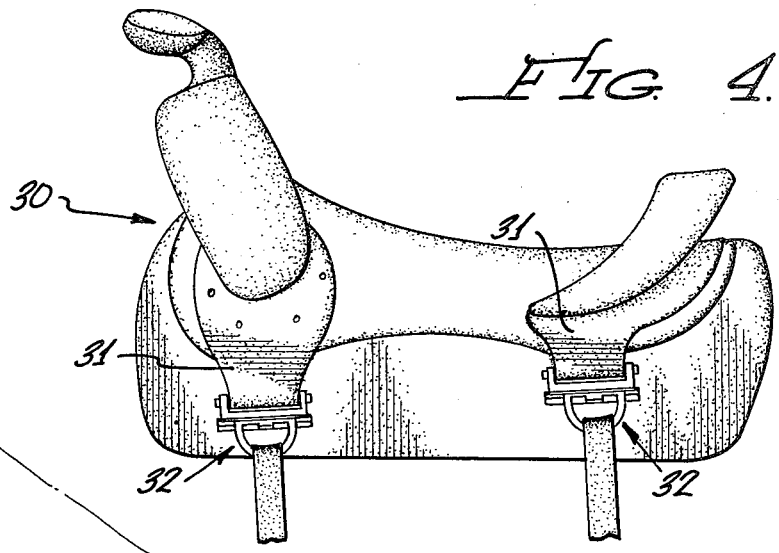
FIG. 4 is an elevation view of a saddle incorporating existing saddle rigging modified to incorporate an alternate embodiment of the present invention.
Figure 5:
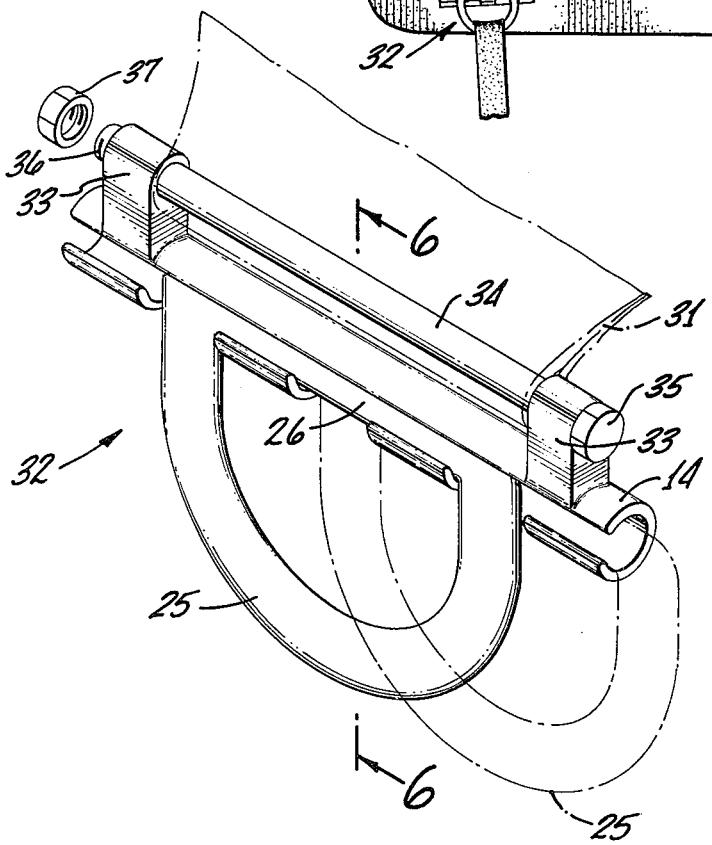
FIG. 5 is an enlarged perspective view of the alternate embodiment of adjustable saddle rigging.
Figure 6:
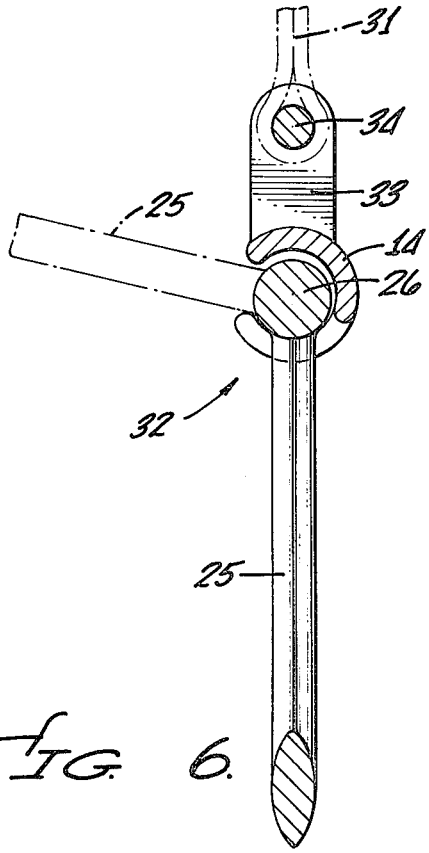
FIG. 6 is an enlarged sectional view taken along the line 6—6 in FIG. 5.

Referring now to FIGS. 4–6, there is shown an alternate embodiment of adjustable saddle rigging, generally designated 32, which is suited for addition to a previously manufactured saddle, generally designated 30. That is, a conventional saddle typically includes skirt members 31, the ends of which are formed into a generally U-shape for receipt of the straight portion of a D-shaped rigging ring. If a rider wants to modify such a saddle to include rigging 12, it may not be possible because of the construction of skirt members 31, or it may not be practical because of the necessity of riveting rigging 12 to a skirt.

Accordingly, saddle rigging 32 incorporates a different means for connecting member 14 to skirt 31. That is, rigging 32 includes a member 14 and a rigging ring 25 which are identical to the same numbered members of rigging 12. On the other hand, member 14 of saddle rigging 32 has a pair of spaced flanges 33 permanently connected to and extending perpendicularly from member 14. The spacing between flanges 33 is slightly greater than the typical width of skirt portions 31. Flanges 33 have aligned holes therein through which a shaft 34 extends. One end of shaft 34 has a head 35 and the other end is threaded at 36, for receipt of a nut 37.

In operation, all that is required is for the existing D-rings to be removed from saddle 30 and this can be accomplished by sawing them off. Once removed, adjustable rigging 32 may be substituted by positioning rigging 32 as shown in FIGS. 4–6 and extending shaft 34 through the aligned holes in flanges 33 and the loop in the bottom of skirt portions 31. With bolt 37 secured to threaded end 36 of shaft 34, operation of rigging 32 proceeds as described previously.

It can therefore be seen that according to the present invention, a saddle may be provided with saddle rigging which is adjustable over multiple positions so that the rider has a clear choice to put the saddle in a place that is good for the horse and good for the rider to do the job with less discomfort to both. The construction of rigging 12 and 32 is compatible with existing saddle designs and D-rings 2 may be positioned in at least three positions to give the rider a wide range of flexibility in adjusting the saddle to the horse. All adjustments could be made without any special tools. Furthermore, because of the adjustability of saddle riggings 12 and 32, the tolerances previously required by the saddle makers in building saddles are substantially loosened, creating increased advantages for the mass production of saddles.

While the invention has been described with respect to the preferred physical embodiments constructed in accordance therewith, it will be apparent to those skilled in the art that various modifications and improvements may be made without departing from the scope and spirit of the invention. Accordingly, it is to be understood that the invention is not to be limited by the specific illustrative embodiments, but only by the scope of the appended claims.

I claim:

1. An adjustable rigging for attaching a saddle to a horse or like animal comprising:

an elongate, generally C-shaped member defining a track for a rigging ring, said member having a plurality of openings therein defining multiple longitudinal positions;

means for connecting said member to a saddle; and a generally D-shaped rigging ring having a straight portion and a curved portion, said straight portion of said rigging ring being slidable within said elongate member to any one of said multiple longitudinal positions, the ends of said curved portion of said rigging ring extending through said openings in said C-shaped member for connection to the ends of said straight portion thereof.

2. An adjustable saddle rigging according to claim 1, wherein the spacing between the facing edges of said C-shaped member is less than the diameter of said straight portion of said rigging ring and greater than the thickness of said curved portion of said rigging ring.

3. An adjustable saddle rigging according to claim 1, wherein the spacing between said ends of said curved portion of said rigging ring is equal to the spacing between said openings in said member.

4. An adjustable saddle rigging according to claim 1, wherein the thickness of the ends of said curved portion of said rigging ring is slightly less than the length of said openings in said member.

5. An adjustable saddle rigging according to claim 1, wherein said connecting means comprises:

a pair of tabs connected to said member and extending laterally therefrom, said tabs being adapted to be connected to a saddle.

6. An adjustable saddle rigging according to claim 5, wherein said tabs have holes therein for receipt of rivets.

7. An adjustable saddle rigging according to claim 1, wherein said connecting means comprises:

a pair of flanges connected to and extending laterally from said member, each of said flanges having a hole extending therethrough, said holes being coaxial;

a shaft extendable through said holes in said flanges, one end of said shaft having a head, the other end of said shaft being threaded; and a nut connected to said threaded end of said shaft.

* * * * *